US007140952B1

(12) United States Patent
Juneau et al.

(10) Patent No.: US 7,140,952 B1
(45) Date of Patent: Nov. 28, 2006

(54) OXIDATION PROTECTED BLADE AND METHOD OF MANUFACTURING

(75) Inventors: Alan Juneau, Mount-Royal (CA); Daniel Lecuyer, Verdun (CA); Alan Bouthillier, Ste-Julie (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 11/231,829

(22) Filed: Sep. 22, 2005

(51) Int. Cl.
*B24B 1/00* (2006.01)

(52) U.S. Cl. ..... 451/54; 451/65; 29/889

(58) Field of Classification Search ..... 451/28, 451/54, 65, 917; 29/889, 889.1, 889.21, 29/889.23

See application file for complete search history.

(56) References Cited

U.S. PATENT DOCUMENTS 4,219,592 A 8/1980 Anderson et al.
4,227,703 A 10/1980 Stalker et al.
4,232,995 A 11/1980 Stalker et al.
4,386,112 A 5/1983 Eaton et al.
4,405,851 A 9/1983 Sheldon
4,600,128 A 7/1986 Rohrer
4,610,698 A 9/1986 Eaton et al.
4,627,896 A 12/1986 Nazmy et al.
4,680,199 A 7/1987 Vontell et al.
4,802,828 A 2/1989 Rutz et al.
4,854,196 A 8/1989 Mehan
5,071,059 A * 12/1991 Heitman et al. ..... 228/244
5,076,897 A 12/1991 Wride et al.
5,102,031 A * 4/1992 Heitman et al. ..... 228/175
5,264,011 A 11/1993 Brown et al.
5,385,760 A 1/1995 Schassberger et al.
5,476,363 A 12/1995 Freling et al.
5,584,663 A 12/1996 Schell et al.
5,622,638 A 4/1997 Schell et al.
5,660,320 A 8/1997 Hoffmüller et al.
5,665,217 A 9/1997 Gruver et al.
5,794,338 A 8/1998 Bowden, Jr. et al.
5,972,424 A 10/1999 Draghi et al.
5,985,467 A 11/1999 Beele
6,224,337 B1 5/2001 Lieland et al.
6,336,950 B1 1/2002 Koizumi et al.
6,365,222 B1 4/2002 Wagner et al.
6,401,460 B1 6/2002 Xia
6,434,876 B1 8/2002 Wheat et al.
6,468,040 B1 10/2002 Grylls
6,478,537 B1 11/2002 Junkin
6,502,304 B1 1/2003 Rigney et al.
6,588,103 B1 7/2003 Fernihough et al.
6,607,358 B1 8/2003 Finn et al.
6,616,410 B1 9/2003 Grylls et al.
6,626,228 B1 9/2003 Bewlay et al.
6,811,379 B1 11/2004 Fernihough
2003/0082053 A1 5/2003 Jackson et al.
2003/0082297 A1 5/2003 Wolkers et al.
2004/0026232 A1 2/2004 Boxman et al.
2005/0003172 A1 1/2005 Wheeler et al.

* cited by examiner

*Primary Examiner*—Jacob K. Ackun, Jr.
(74) *Attorney, Agent, or Firm*—Ogilvy Renault, LLP

(57) ABSTRACT

The surface of a gas turbine blade is machined with a material-removing tool and simultaneously, an anti-oxidation coating is deposited on the surface using eletrospark deposition.

11 Claims, 2 Drawing Sheets

OXIDATION PROTECTED BLADE AND METHOD OF MANUFACTURING

TECHNICAL FIELD

The field of invention relates generally to the protection of blades in a gas turbine engine and, more particularly, to a blade provided with an oxidation protection layer and a method of manufacturing the same.

BACKGROUND OF THE ART

In small gas turbine engines, the shrouds located around the turbine blades are generally not provided with a layer of abradable material, as is the case for some larger engines. Reasons for this include the facts that large engines may have more carcass distortions and more misalignment between centerlines of the rotor and shrouds. A distortion or misalignment may cause a localized rub between a shroud segment and all blades. Without an abradable system, this may leave a relatively large gap around the periphery of the rotor and reduce the efficiency of the engine. Smaller engines take advantage of having less carcass distortions and misalignments by designing to have tighter tip clearances. One method of achieving tight tip clearances on smaller engines is to machine blades to their final dimensions so that the designed tip clearance is achieved even without a running-in period.

Whenever parts are machined to their final dimension, for instance using a grinder, some material is removed. Since the parts are coated with one or more protective layers before the final machining process, removing more material than the thickness of the protective layer or layers will leave the base material exposed. The exposed areas will then be prone to oxidation. Oxidation is particularly severe at the edge of the pressure side of blades This ultimately results in a premature wear of the blades.

Accordingly, there is a need to provide an improved way of protecting from oxidation the surfaces of the blades that are machined because their base material is exposed once machined to their final dimension.

SUMMARY OF THE INVENTION

In one aspect, the present invention provides an apparatus for providing an anti-oxidation layer on blades used in a gas turbine engine, the apparatus comprising: a material-removing tool to machine at least one surface of the blades; an electrospark applicator to deposit an anti-oxidation coating on the surface immediately after being machined, the applicator operating simultaneously with the tool.

In another aspect, the present invention provides an apparatus for machining a surface of a blade for use in a gas turbine engine, the apparatus comprising: means for removing material from a portion of the surface of the blade; and means for depositing an anti-oxidation coating on the portion of the surface, using eletrospark deposition, immediately after the removal of material therefrom.

In another aspect, the present invention provides a method of preparing a surface of a blade, used in a gas turbine engine, to its final dimension, the method comprising: (a) removing material from a portion of the surface; and then (b) depositing an anti-oxidation coating on the portion of the surface using eletrospark deposition.

Further details of these and other aspects of the present invention will be apparent from the detailed description and accompanying figures.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
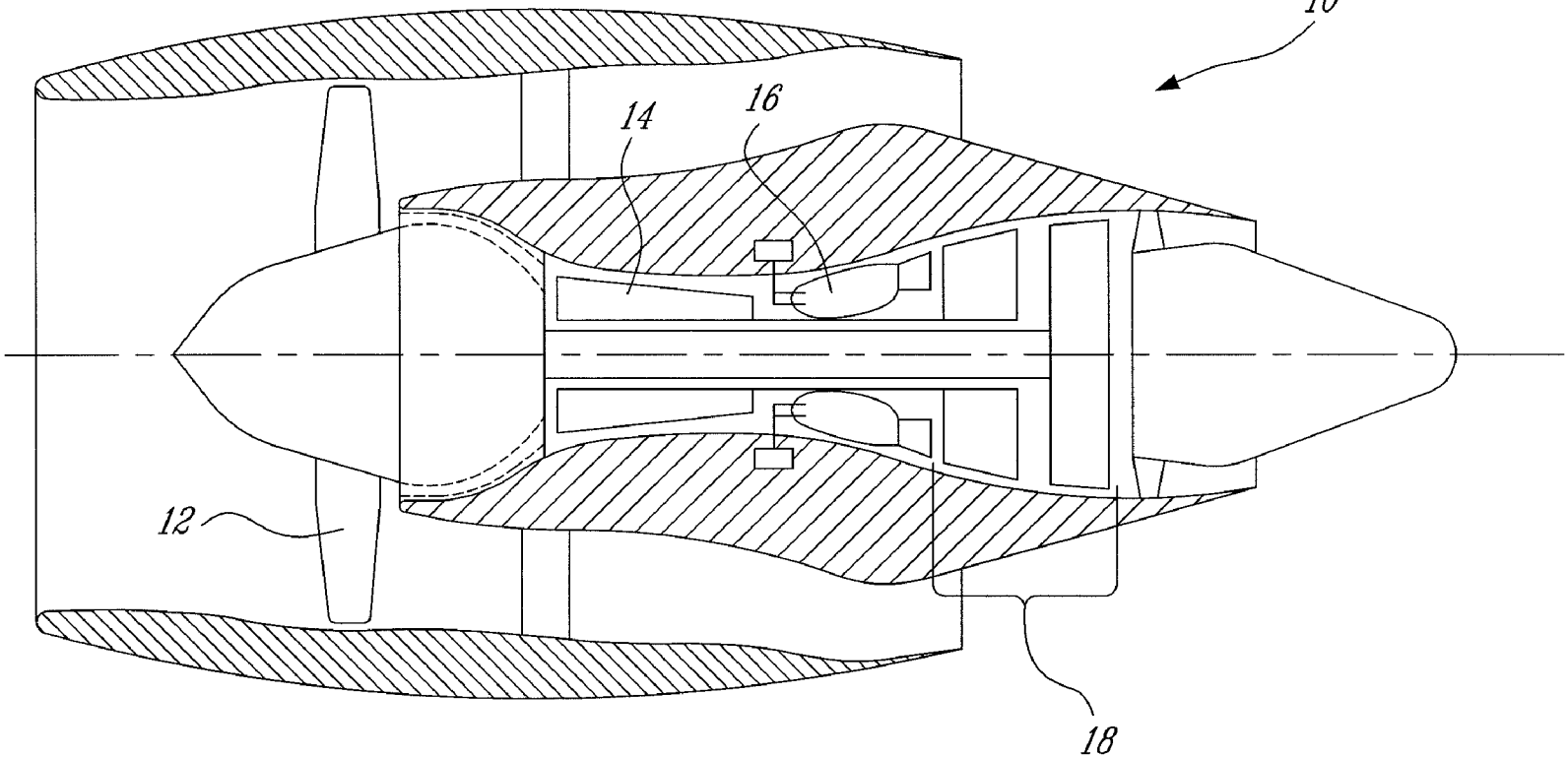
FIG. 1 is a schematic view of a gas turbine engine showing an example of a possible environment in which the turbine blades are used.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. This figure shows one possible environment in which blades with oxidation protection can be used. It should be noted at this point that the invention is equally applicable to other kinds of gas turbine engines, such as turbo shafts or turbo props.

Figure 2:
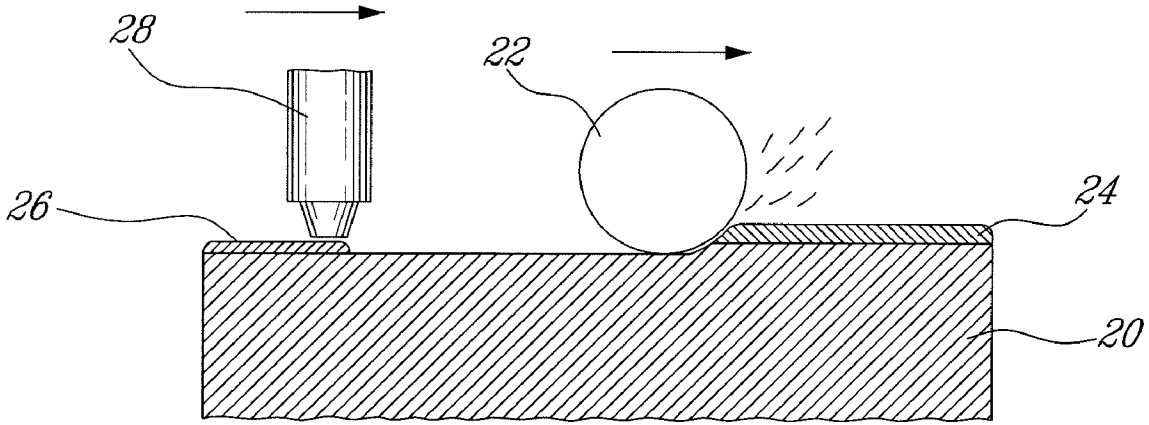
FIG. 2 is a schematic view of the manufacturing process, in accordance with a preferred embodiment of the invention.

FIG. 2 schematically shows a surface of a blade 20 being manufactured in accordance with the present invention. It shows that material is removed from the surface using a material-removing tool, for instance a grinder 22. If the grinder 22 removes more material than the thickness of the original anti-oxidation layer 24 of the blade 20, the base material will be exposed. However, at the same time, a very thin layer of anti-oxidation coating 26 is applied using an electrospark applicator 28 to solve that problem.

Electrospark deposition (ESD) is a pulsed micro-welding process. Based on short duration, high current pulses, ESD imparts a low heat input to the base material, resulting in little or even no modification of the substrate microstructure. The base material remains near to ambient temperature so that thermal distortion, shrinkage and high residual stresses are avoided. The precision of the machining is thus intact. An example of a corrosion resistant material is MCrAlY.

The grinder 22 and the applicator 28 can be mounted on the same frame (not shown), which will preserve the datum line and increase the precision of the machining. The frame can be movable with reference to the blade 20, or vice-versa. Another possibility is to mount the blade 20 on a rotating support while the grinder 22 and the applicator 28 are fixed. This rotating support can be a rotor disk.

The combined machining and eletrospark deposition can be repeated one or more times for each surface until the final dimension is obtained. The machining may, in that case, even remove some of the anti-oxidation coating 26 previously laid by the ESD as part of the material being removed. Likewise, the anti-oxidation coating 26 can be applied on a partially-removed anti-oxidation layer 24.

The ESD tool may be designed to have a conformal shape to the blade 20 or its tip. This way, it is possible to apply the coating on the whole surface simultaneously. Yet, the ESD tool may be a rotating tool mounted on a wheel-like support.

Overall, the apparatus and the method of the present invention allow blades of gas turbine engines to have tight tip clearances, which is particularly useful in the case of small gas turbine engines. It allows the blades to have these tight tip clearances without leaving the base surface with no protection, thus prone to oxidation.

If desired, the gap at the tip of a blade 20 may receive additional coating using the electrospark deposition. It is possible to superpose multiple layers of anti-oxidation coating 26 to increase the protection. Some areas may still be prone to wear with only one layer and accordingly, the additional thickness of many layers of anti-oxidation coating 26 will prevent the base material from being uncovered.

Recessed portions of blades can receive more anti-oxidation coating than non-recessed portions without affecting the tip clearance.

The above description is meant to be exemplary only, and one skilled in the art will recognize that changes may be made to the embodiments described without departing from the scope of the invention disclosed. For example, the material-removing tool can be different than a grinder and may include any other equivalent machining device, such as a milling cutter. The coating material is not limited to MCrAlY and other anti-oxidation coatings can be used, as apparent to a person skilled in the art. The process being disclosed herein is not limited to new blades and can be used for refurbished blades. Still other modifications which fall within the scope of the present invention will be apparent to those skilled in the art, in light of a review of this disclosure, and such modifications are intended to fall within the appended claims.

What is claimed is:

1. An apparatus for providing an anti-oxidation layer on blades used in a gas turbine engine, the apparatus comprising:

a material-removing tool to machine at least one surface of the blades;

an electrospark applicator to deposit an anti-oxidation coating on the surface immediately after being machined, the applicator operating simultaneously with the tool.

2. The apparatus as defined in claim 1, wherein the material-removal tool comprises a grinder.

3. The apparatus as defined in claim 1, wherein the surface of the blade is located at the tip thereof.

4. An apparatus for machining a surface of a blade for use in a gas turbine engine, the apparatus comprising:

means for removing material from a portion of the surface of the blade; and means for depositing an anti-oxidation coating on the portion of the surface, using eletrospark deposition, immediately after the removal of material therefrom.

5. The apparatus as defined in claim 4, wherein the means for removing material comprise a grinder.

6. The apparatus as defined in claim 4, wherein the surface of the blade is located at the tip thereof.

7. A method of providing an anti-oxidation layer on a blade for a gas turbine engine, the method comprising:

(a) removing material from a portion of a surface of the blade by machining; and (b) simultaneously depositing the anti-oxidation layer on the machined portion of the surface of the blade using eletrospark deposition.

8. The method as defined in claim 7, wherein steps (a) and (b) are repeated until the final dimension is obtained.

9. The method as defined in claim 7, wherein the material removed from the machined portion of the surface of the blade includes at least a portion of a previously laid anti-oxidation layer.

10. The method as defined in claim 7, wherein the material is removed by grinding.

11. The method as defined in claim 7, wherein the machined portion of the surface of the blade is located at the tip thereof.

* * * * *